US005404685A

United States Patent [19]

Collins

[11] Patent Number: 5,404,685

[45] Date of Patent: Apr. 11, 1995

[54] POLYSTYRENE FOAMED PLASTIC WALL APPARATUS AND METHOD OF CONSTRUCTION

[76] Inventor: Dennis W. Collins, 3303 N. Morino St., Chandler, Ariz. 85224

[21] Appl. No.: 937,297

[22] Filed: Aug. 31, 1992

[51] Int. Cl.[6] ..... F04H 17/16

[52] U.S. Cl. ..... 52/309.7; 52/295; 52/309.9; 52/309.12; 52/309.17; 52/780; 52/743; 52/745.05; 256/19; 256/24

[58] Field of Search ..... 256/19, 24; 52/780, 52/777, 309.7, 309.8, 309.9, 309.12, 309.16, 309.17, 295, 296, 297, 283, 434, 440, 743, 745.05, 309.4; 446/105, 108, 111

[56] References Cited

U.S. PATENT DOCUMENTS

| | | | |
|---|---|---|---|
| 910,950 | 1/1909 | Noll | 52/283 X |
| 1,045,521 | 11/1912 | Conzelman | 52/274 X |
| 1,114,504 | 10/1914 | Conzelman | 52/780 X |
| 1,343,926 | 6/1920 | Madsen | 52/780 X |
| 1,428,420 | 9/1922 | Branerd | 52/780 X |
| 1,706,696 | 3/1929 | Kohler | 446/105 |
| 1,714,949 | 5/1929 | Collier et al. | 256/19 X |
| 2,057,018 | 10/1936 | Dillon | 256/19 |
| 2,104,869 | 1/1938 | Levy | 52/274 |
| 2,104,871 | 1/1938 | Levy | 52/274 X |
| 2,262,899 | 11/1941 | Mechin | 52/380 X |
| 2,351,856 | 6/1944 | Henderson | 52/283 X |
| 2,532,524 | 12/1950 | Walker | 256/19 X |
| 2,745,638 | 5/1956 | O'Connor | 256/19 |
| 2,748,592 | 6/1956 | Kelly | 52/780 X |
| 3,381,483 | 5/1968 | Huthsing, Jr. . | |
| 3,473,285 | 10/1969 | Reiland | 52/295 X |
| 3,617,023 | 11/1971 | Bach . | |
| 3,698,692 | 10/1972 | Burrows, Jr. . | |
| 4,193,584 | 3/1980 | Wieser . | |
| 4,231,552 | 11/1980 | Thomas | 256/24 |
| 4,270,302 | 6/1981 | Dandia | 446/105 |
| 4,292,783 | 10/1981 | Mulvihill | 52/309.12 X |
| 4,300,323 | 11/1981 | Meechan et al. . | |
| 4,386,762 | 6/1983 | Collins . | |
| 4,594,829 | 6/1986 | Herrgord . | |
| 4,625,484 | 12/1986 | Oboler | 52/309.12 X |
| 4,674,242 | 6/1987 | Oboler et al. | 52/91 |
| 4,690,383 | 9/1987 | Batcheller . | |
| 4,765,105 | 8/1988 | Tissington et al. . | |
| 4,823,534 | 4/1989 | Hebinck | 52/743 |
| 4,875,622 | 10/1989 | Lents . | |

FOREIGN PATENT DOCUMENTS

| | | | |
|---|---|---|---|
| 0977667 | 4/1951 | France | 52/274 |

*Primary Examiner*—Carl D. Friedman
*Assistant Examiner*—Robert Canfield
*Attorney, Agent, or Firm*—Donald J. Lisa; Steven Lin

[57] ABSTRACT

An outside STYROFOAMv polystyrene plastic wall or fence is constructed by anchoring each of at least two styrofoam H-columns to a concrete base in the ground supporting a steel reinforcing bar which extends up into a hollow of the column by filling the hollows with concrete. A STYROFOAM TM polystyrene plastic panel is supported within the grooves of juxtaposed columns. The fence may have any desired length. The panel is secured to the two columns by L-shaped rebars or a continuous length of rebar laid in a recessed groove atop each panel and column and anchored in the concrete in the column hollows. An exterior mesh-stucco or paint finish covers the wall. Columns—in—line, L, T—and panels—square or T—enable making walls of any shape or configuration.

36 Claims, 4 Drawing Sheets

POLYSTYRENE FOAMED PLASTIC WALL APPARATUS AND METHOD OF CONSTRUCTION

BACKGROUND OF THE INVENTION

1. The Field Of The Invention

The present invention relates generally to a Polystyrene Foamed Plastic Wall Apparatus and its method of construction, and more particularly, to an outside STYROFOAM TM polystyrene plastic fence comprised of at least one panel supported between at least two H-columns and associated reinforcing and attaching features and exterior finish.

[1]A trademark for a light, resilient polystyrene plastic.

2. DISCUSSION OF BACKGROUND AND PRIOR ART

Walls and fences are manufactured from different types of materials. Some of the more common types of materials that walls and fences are made of are wood, brick, masonry block, or wire. Wood walls or fences have the disadvantage in that they can be more easily damaged or chipped.

The surface of a wood wall or fence begins to weather down after a period of time, and pieces of the wall or fence have to be replaced on a periodic basis. A wood wall or fence is not as sturdy as the other types of walls or fences, and it may not stand up against the wind as well as the others.

A wire wall or fence is also not as sturdy or solid as the other types of fences. Typically, a wire wall or fence encompasses a certain area, but the surface of the wall or fence is usually not covered. A wire wall or fence also has the disadvantages of a person being able to cut through it, or a person bending the surfaces or sides of the wire wall or fence.

Brick or masonry block type walls and fences have the advantage of being strong and sturdy. They hold up very well against the wind, and they are not easily broken. They have the further advantage in that stucco can be applied to the surface of the wall or fence to create a more appealing aesthetics especially for a wall or fence that can be matched to the exterior of a house. These types of walls or fences have been required by certain municipal housing or zoning laws.

Brick or block masonry type walls or fences, however, have several disadvantages. They are more expensive because they require significant time, labor, and material to construct. Another problem with these types of walls or fences is that the top row of bricks or blocks can be easily knocked off. These brick and masonry block type walls or fences have the further problem of weight settling which in effect causes ladder cracks in the surfaces and sides of the wall or fence.

Thus, there is not available on the market today a wall or fence that is mainly constructed of polystyrene foamed plastic that is fairly sturdy, that provides an appealing aesthetic look, that is easy and inexpensive to construct, and that would not have chipping or cracking problems.

SUMMARY OF THE INVENTION

Set forth below is a brief summary of the invention in order to overcome the foregoing problems and achieve the foregoing and other objects and advantages in accordance with the purposes of the present invention as embodied and broadly described herein.

One aspect of the invention is a wall or fence apparatus that is mainly constructed of polystyrene plastic material, and more particularly, STYROFOAM TM polystyrene plastic and its method of construction.

A second aspect of the invention is that the wall or fence comprises at least one styrofoam panel supported within at least two reinforced H-columns anchored in the ground, and an exterior finish for the entire wall or fence.

A third aspect of the invention is the method of manufacturing a wall or fence that is mainly constructed of polystyrene plastic material and, more particularly, STYROFOAM TM polystyrene plastic.

Further features of the invention include various shaped columns to form T's and corners that fit the panels in various ways and various reinforcing structures and attaching features that provide various ways of holding the columns and panels together and to the ground.

BRIEF DESCRIPTION OF THE DRAWINGS

The accompanying drawings, which are incorporated in and form a part of the specification, illustrate several embodiments of the present invention and together with the description, serve to explain the principles of the invention. In the drawings.

DETAILED DESCRIPTION OF THE INVENTION

Figure 1:
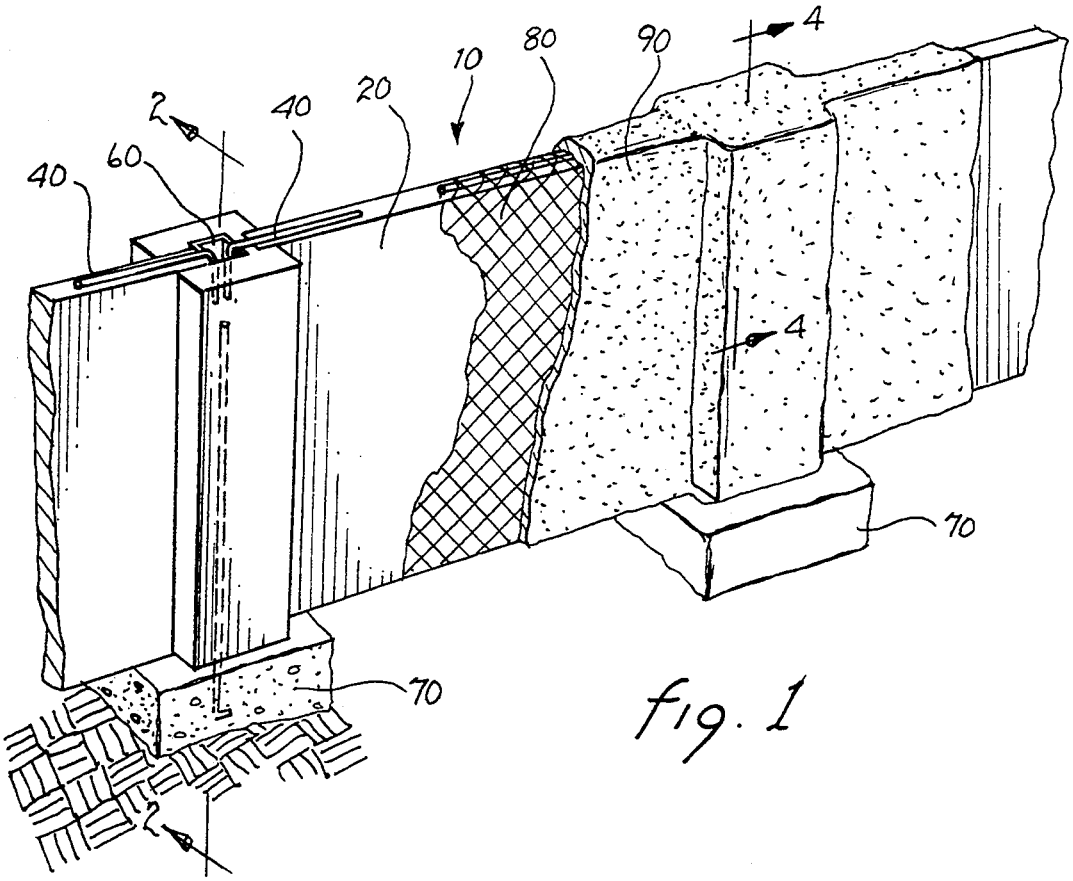
FIG. 1—Perspective view of the Polystyrene Foamed Plastic Wall Apparatus with open portion showing the inner parts of the wall with the L-shaped attachment bars.

As seen in FIG. 1, the wall apparatus 10 comprises panel(s) 20 that are inserted in the grooves of the columns 30 so that the panels and columns fit snugly together. These columns and panels are made of STYROFOAM TM polystyrene plastic, which is best described as a well known polystyrene foamed plastic. The columns 30 are secured in the ground so that they firmly stand up to support the panel(s) 20. The panel(s) 20 are then fastened to the columns 30. An exterior finish 90 is then applied to the entire wall structure.

The Columns

The columns 30 may have various shapes depending on the function of the column and the number and ways the panels 20 are to be attached, as seen in FIGS. 8–13 which are merely exemplary of some embodiments.

Figure 8:
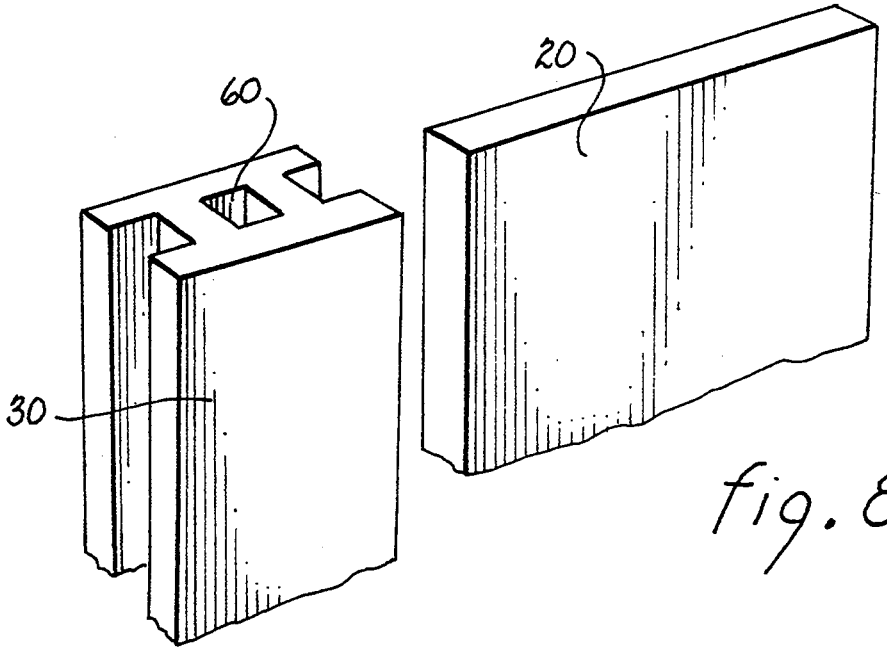
FIG. 8—Perspective view of a first embodiment in-line column which is an H-column and a panel that is attached to the H-column.

FIG. 8 shows a column 30 as an in-line, H-column in which the panel 20 is inserted in the groove of the column 30. The H-columns provide two in-line grooves opposite sides of the hollow 60. A series of panels 20 and columns 30 can be connected together in a line in order to create a length of wall that is any desired length.

Figure 9:
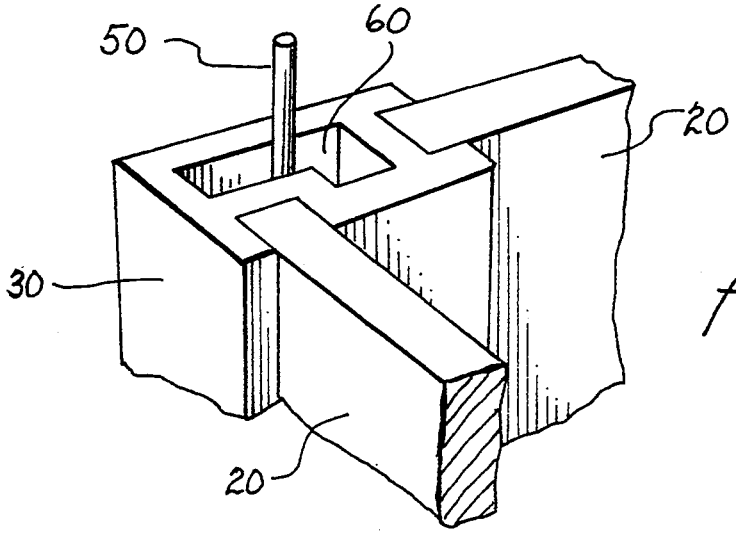
FIG. 9—Perspective view of a second embodiment corner column where two panels are attached perpendicularly to the column.

FIG. 9 shows a corner-column 30 which is shaped to have two panels 20 attached perpendicularly to each other. These columns and panels are often used to create the corner of a wall or a fence.

Figure 10:
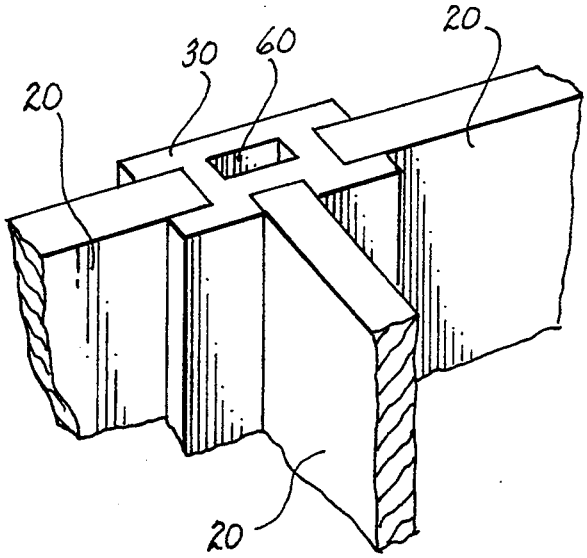
FIG. 10—Perspective view of a third embodiment T-column where three panels are attached in a T-shape configuration to the column.

FIG. 10 shows a T-column 30 which is shaped to have three panels 20 attached to each other in a T-shape configuration. This configuration is useful when using a wall portion to separate two areas.

Figure 11:
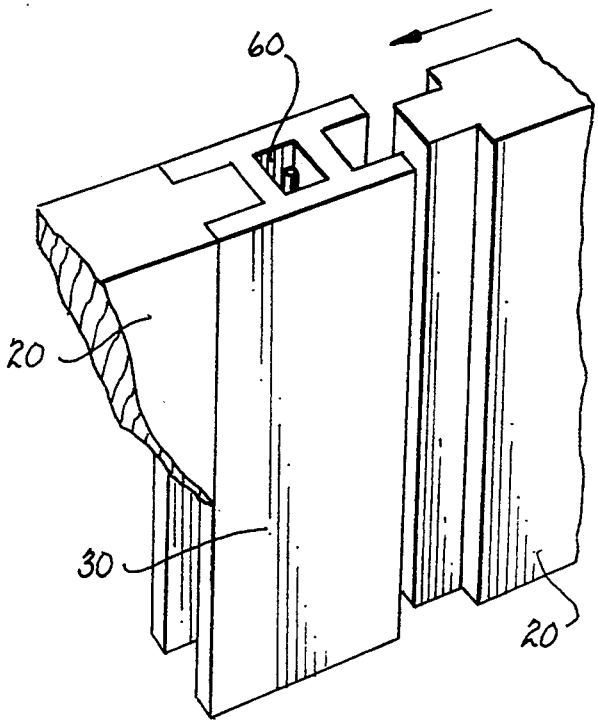
FIG. 11—Perspective view of an in-line H-column showing a second embodiment of the panel that can be inserted in the groove of the H-column.

FIG. 11 shows an in-line H-column 30 with panel 20 configured with a tongue 21 and integral wider portions 22, 23 which would typically be used when creating a flush-looking wall or fence.

Figure 12:
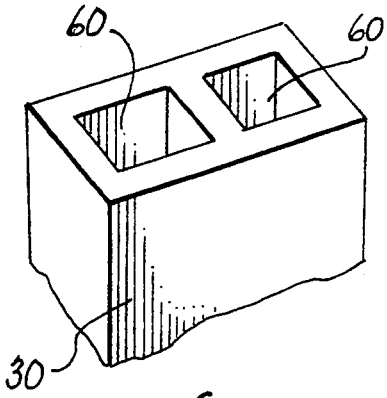
FIG. 12—Perspective view of a fifth embodiment column where the column has no attached panels.

FIG. 12 shows a completely enclosed column 30 with double hollows 60. Panels cannot be secured to this type of column 30 which is used to make a post that can have a variety of uses.

Figure 13:
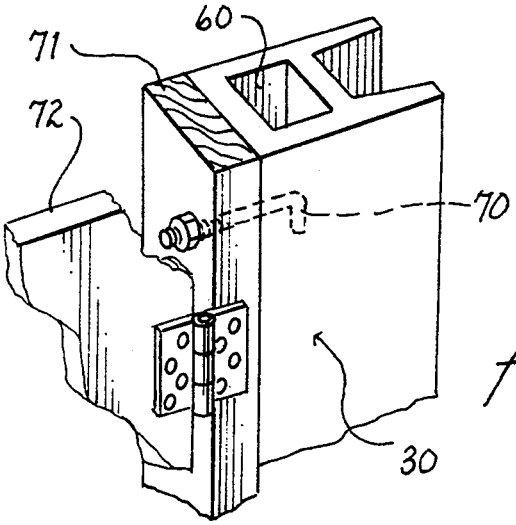
FIG. 13—Perspective view of a sixth embodiment column where the column is attached to a different type of panel.

FIG. 13 shows an A-column 30 which is used as an end column to which an L-shaped stud 70 may be anchored to which a two-by-four 71 may be secured to which a gate 72 may be hung, for example. This embodiment differs from FIG. 11 in that the shape of the panel 20 that is secured in the groove of column 30 of FIG. 13 would have a trapezoidal shaped tongue rather than a square shaped tongue.

The Panels

The panels 20 also have different embodiments that are made of various shapes and sizes. The main important feature of the panels 20 is the shape of the tongue that will have to fit into the groove of the columns 30. Therefore, the type of panel 20 that is used to construct a wall will depend on the type of columns 30 that are used since the columns and panels have to fit snugly together.

FIG. 8 shows a perspective view of a first embodiment of the panels 20 in which the panel is a rectangular box shape with a width that would fit into the groove of the column 30. This is one of the more typical embodiments that would be used. However, the configuration that is created with these types of panels and columns are such that it cannot create a flush wall surface because the surface at the columns will be protruding outwards from the surface of the panels.

As seen in FIG. 11, however, this problem is eliminated. The panel 20 is shaped to have the same width as the column 30 and has a tongue at the end of the panel that is of a width and depth perfectly sized to fit the groove of the column 30.

As seen in FIG. 13, the tongue of the panel 20 would be trapezoidal shaped as opposed to rectangular shaped as shown in the embodiment in FIG. 11.

Column Support Base and Column Reinforcing Structure

The columns 30 in any of the embodiments are secured in the ground in a number of ways, such as, by using reinforcement bars and a concrete footing.

Figure 2:
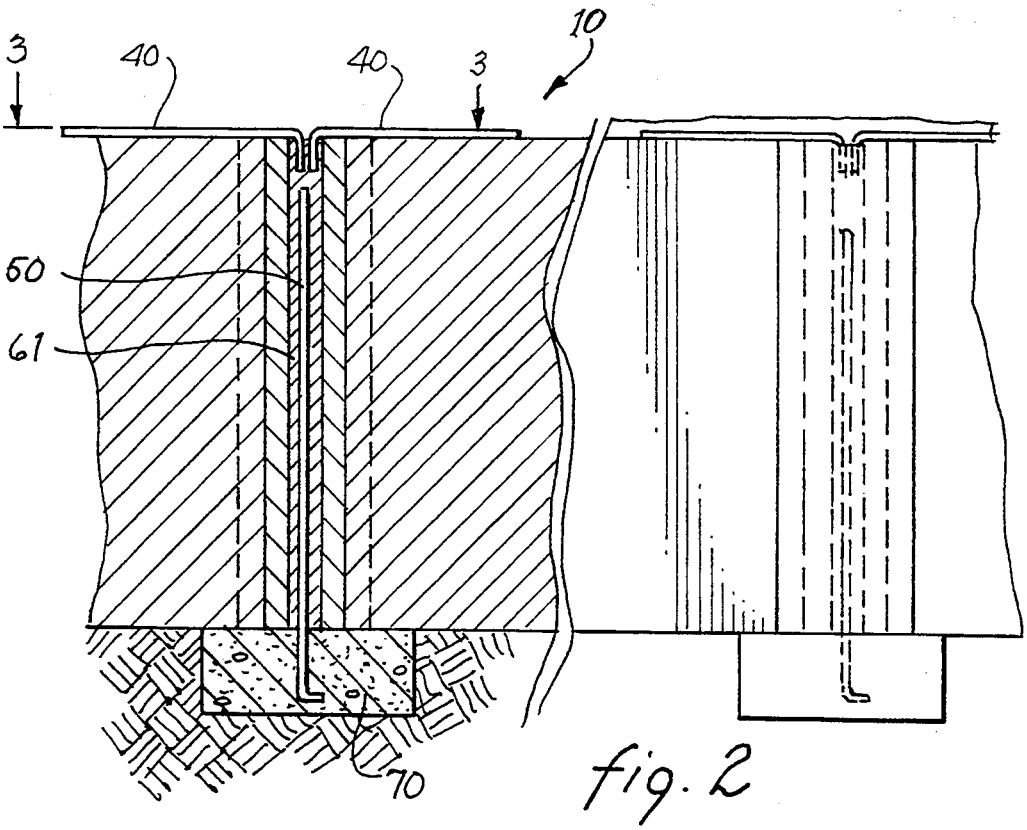
FIG. 2—2—2 cross-sectional side elevation view of the Polystyrene Foamed Plastic Wall Apparatus of FIG. 1 with cross-sectional portions showing the inner parts of the wall.

As seen in FIG. 2, a reinforcing structural bar 50 is secured in a concrete footing 70 firmly sunk in the ground. The reinforcement bars 50 are sunk in the concrete while it is still wet and extend upwardly above the ground.

The bar 50 is essential in providing the structural reinforcement to the columns 30. All of the embodiments of the column 30 are formed with a central hollow 60 from the top to the bottom of the column. The column 30 is placed over the reinforcement bar 50 which extends into the central hollow 60.

A reinforcing filler, such as, concrete is then poured into the central hollow 60 of the column 30 which, when hardened, is shown as concrete portion 61. The concrete portion 61 in FIG. 4 functions to secure the column 30 to the reinforcement bar 50 upon the concrete footing 70 thereby providing structural stability to the column 30.

Column/Panel Structural Fasteners

After the columns 30 are structurally reinforced to bar 50 as aforesaid the ends of each panel 20 are inserted into the grooves of juxtaposed columns 30 to form a wall portion. By repeating the process with other juxtaposed columns of various shapes, as aforesaid, the wall may have any length or shape as desired.

The panels 20 and columns 30 then have to be fastened together. FIG. 1 shows one method of attaching the columns and panels together by the use of L-shaped attachment bars 40.

Figure 3:
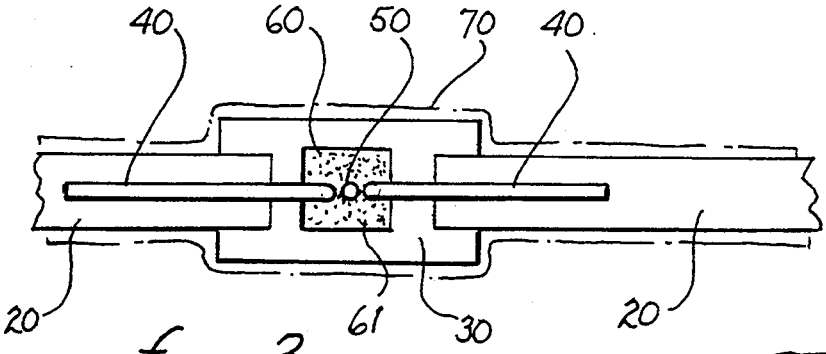
FIG. 3—3—3 top plan view of the Polystyrene Foamed Plastic Wall Apparatus of FIG. 2.
Figure 4:
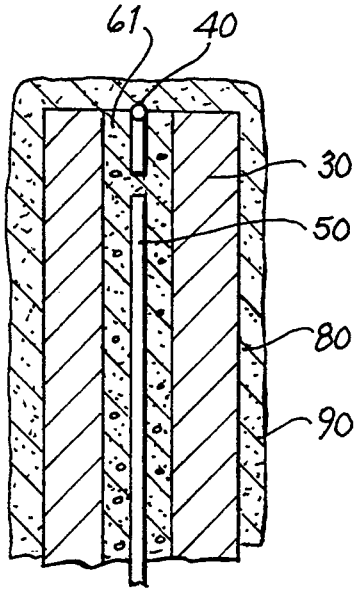
FIG. 4—4—4 cross-sectional elevation view of the Polystyrene Foamed Plastic Wall Apparatus of FIG. 1.

The attachment bars 40 are placed in grooves that are recessed in the top of the columns 30. FIG. 3 shows the top plan view of the wall apparatus of FIG. 2 where the L-shaped attachment bars are placed. The reinforcing structural bar 50 is centered in the hollow 60 of column 30. The short end of the L-shaped attachment bar 40 is placed in the wet concrete which is allowed to harden. In FIG. 4, the 4—4 cross-sectional side elevation view of FIG. 1 shows the location of the attachment bar 40 placed in the concrete. After the concrete hardens, the panels 20 are then securely attached to the columns 30.

Figure 6:
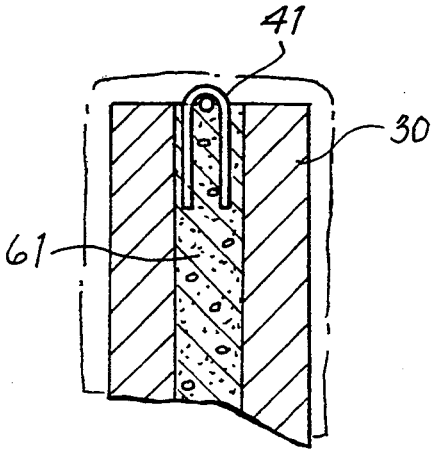
FIG. 6—6—6 cross-sectional elevation view of the Polystyrene Foamed Plastic Wall Apparatus of FIG. 5.
Figure 5:
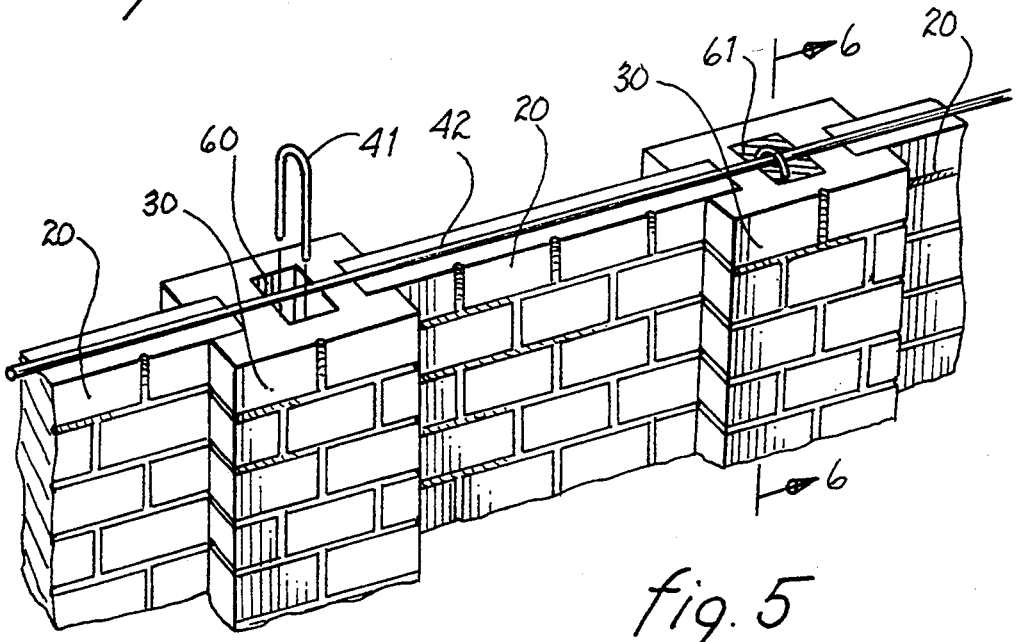
FIG. 5—Perspective view of the Polystyrene Foamed Plastic Wall Apparatus with U-joints and straight bar attachments.
Figure 7:
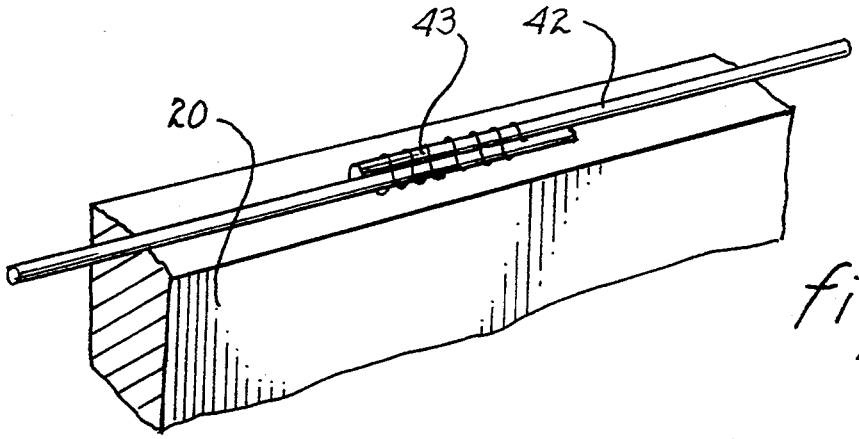
FIG. 7—Perspective view of two straight reinforcement bars that are tied together and placed on top of the Polystyrene Foamed Plastic Wall Apparatus.

A second method of fastening the panels 20 to the columns 30 is shown in FIG. 5. Instead of using the L-shaped attachment bars 40, a continuous reinforcing structural bar 42 is placed along the grooves on top of the panels 20 and columns 30. If a longer reinforcing bar 42 is needed, FIG. 7 shows that two reinforcing bars may be attached together by tie wire 43. A U-shaped joint 41 is then placed into the wet concrete that was poured in the hollow 60 of column 30. The U-shaped joint 41 is placed upside down into the concrete so that the bottom of the U contacts the reinforcing bar 42. After the concrete hardens the panels 20 are secured to the columns 30. In FIG. 6, a cross-sectional of FIG. 5 shows the placement of both the reinforcing bar 42 and U-shaped joint 41.

Exterior Finish for Entire Wall Apparatus

After the columns have been secured in the ground and the columns and panels are attached to each other, an exterior finish is then applied to the entire wall apparatus.

A good way to obtain a hard surface when constructing the wall apparatus is to apply stucco to the entire surface of the wall. As shown in FIG. 1, a netted mesh 80 is first placed over the surface of the entire wall. Stucco 90 is then applied over the entire netted area. After the stucco 90 dries, this provides the entire wall with a good hard surface.

A second method of obtaining a hardened surface after the STYROFOAM TM polystyrene plastic columns and panels are placed together is to use special exterior paint which forms a hard coating. After the applied paint drys, a hard surface will be provided to the wall since the paint is specially designed to perform this function.

FIG. 5 shows an alternative exterior finish for the entire wall apparatus. The STYROFOAM TM polystyrene plastic panels and columns have been molded and formed so that the wall or fence that is constructed has raised, rectangular blocks 21 and grooves 22 throughout its surface. The special exterior paint, as referred to earlier, is then applied to the entire surface of the wall or fence so that a hard coated surface is formed. After the paint dries, the wall or fence has the appearance of a brick veneer finish.

The foregoing description of a preferred embodiment and best mode of the invention known to applicant at the time of filing the application has been presented for the purposes of illustration and description. It is not intended to be exhaustive or to limit the invention to the precise form disclosed, and obviously many modifications and variations are possible in the light of the above teaching. The embodiments were chosen and described as the best modes known to the invention and best explains the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A wall apparatus comprising:

at least one panel supported by at least two polystyrene plastic support columns each of which has a central hollow and a reinforcing structural member secured to a support base, at least one structural fastener which secures the at least one panel and at least one of the at least two columns together; and an exterior finish applied to the entire wall apparatus.

2. A wall apparatus according to claim 1 wherein the structural fastener is at least one reinforcing bar which attaches the at least one panel and the at least one of the at least two columns together.

3. A wall apparatus according to claim 2 wherein the at least one reinforcing bar attaches the at least one panel and at least two columns together and is a pair of L-shaped, reinforcing bars.

4. A wall apparatus according to claim 2 wherein the at least one reinforcing bar which attaches the at least one panel and the at least one of the at least two columns together is a straight reinforcing bar laid in a recessed groove in the top of the at least one panel and the at least two columns with U-shaped joints that attach the bar to the columns.

5. A wall apparatus according to claim 4 wherein the straight reinforcing bar is comprised of multiple reinforcing bars that are tied together.

6. A wall apparatus according to claim 1 wherein the reinforcing structural member for each of the columns is a reinforcing bar.

7. A wall apparatus according to claim 1 wherein the support base for each of the reinforcing structural members is comprised of a concrete footing.

8. A wall apparatus according to claim 1 wherein the wall apparatus is made to be part of a fence.

9. A wall apparatus according to claim 1 further comprising a filler in the central hollow of each column.

10. A wall apparatus according to claim 9 wherein the filler provides structural support to the columns.

11. A wall apparatus according to claim 10 wherein the reinforcing filler is concrete.

12. A wall apparatus according to claim 1 wherein the at least one panel is at least one polystyrene plastic panel.

13. A wall apparatus comprising:

at least one polystyrene plastic panel supported by at least two support columns each of which has a central hollow and a reinforcing structural member secured to a support base;

at least one structural fastener which secures the at least one panel and at least one of the at least two columns together; and an exterior finish applied to the entire wall apparatus.

14. A wall apparatus comprising:

at least one panel supported by at least two polystyrene plastic support columns each of which has a reinforcing structural member secured to a support base;

at least one reinforcing bar which secures the at least one panel and at least one of the at least two columns together; and an exterior finish applied to the entire wall apparatus.

15. A wall apparatus according to claim 14 wherein the at least one reinforcing bar attaches the at least one panel and at least two columns together and is a pair of L-shaped, reinforcing bars.

16. A wall apparatus according to claim 14 wherein the at least one reinforcing bar which attaches the at least one panel and the at least one of the at least two columns together is a straight reinforcing bar laid in a recessed groove in the top of the at least one panel and the at least two columns with U-shaped joints that attach the bar to the columns.

17. A wall apparatus according to claim 16 wherein the straight reinforcing bar is comprised of multiple reinforcing bars that are tied together.

18. A wall apparatus comprising:

at least one polystyrene plastic panel supported by at least two support columns each of which has a reinforcing structural member secured to a support base;

at least one reinforcing bar which secures the at least one panel and at least one of the at least two columns together; and an exterior finish applied to the entire wall apparatus.

19. A method of constructing a wall apparatus comprising the steps of:

structurally reinforcing at least two polystyrene plastic support columns in the ground wherein each column has a central hollow;

attaching at least one panel to the at least two support columns;

structurally fastening the at least one panel and at least one of the at least two columns together; and applying an exterior finish to the entire wall apparatus.

20. A method of constructing a wall apparatus comprising the steps of:

structurally reinforcing at least two support columns in the ground wherein each column has a central hollow;

attaching at least one polystyrene plastic panel to the at least two support columns;

structurally fastening the at least one panel and at least One of the at least two columns together; and applying an exterior finish to the entire wall apparatus.

21. The method of constructing a wall apparatus according to claim 20 wherein the step of structurally reinforcing the columns in the ground comprises the steps of:

securing a reinforcing structural member to a support base in the ground for each column;

placing each column on one of the support bases with the reinforcing member extending into the hollow of the column; and filling the hollow of each column with a reinforcing filler.

22. The method of constructing a wall apparatus according to claim 20 wherein the step of applying an exterior finish to the entire wall apparatus comprises the steps of:

placing a netted mesh over the entire wall apparatus; and applying stucco material to the exterior of the netted mesh to enhance strength and appearance of the wall apparatus.

23. The method of constructing a wall apparatus according to claim 20 wherein the step of applying an exterior finish to the entire wall apparatus comprises the step of applying paint to an exterior of the wall apparatus.

24. A method of constructing a wall apparatus comprising the steps of:

structurally reinforcing at least two polystyrene plastic support columns in the ground;

attaching at least one panel to the at least two support columns;

using at least one reinforcing bar to structurally fasten the at least one panel and at least one of the at least two columns together; and applying an exterior finish to the entire wall apparatus.

25. A method of constructing a wall apparatus comprising the steps of:

structurally reinforcing at least two support columns in the ground;

attaching at least one polystyrene plastic panel to the at least two support columns;

using at least one reinforcing bar to structurally fasten the at least one panel and at least one column together; and applying an exterior finish to the entire wall apparatus.

26. A panel fence comprising:

at least one polystyrene plastic panel held in place by a pair of H-shaped polystyrene plastic columns secured to a footing by a column reinforcing member; and a top rail comprising a continuous length of a fence reinforcing member laid in a groove at the top edge of the entire fence.

27. A panel fence according to claim 26 further comprising:

a stucco coating applied to the surface of the fence.

28. A panel fence according to claim 26 further comprising:

a brick veneer finish applied to the surface of the fence.

29. A panel fence according to claim 26 wherein:

the footing is concrete.

30. A panel fence according to claim 26 wherein:

the column reinforcing member is steel rebar.

31. A panel fence according to claim 24 wherein the fence reinforcing member is steel rebar.

32. A method of making a polystyrene plastic fence comprising:

supporting each of at least two H columns having a central hollow on a concrete footing by placing each column over a rebar which is secured in the concrete footing and extends into the central hollow of each column, then, pouring concrete into the central hollow so that each column structure is reinforced to the rebar and the footing, and supporting at least one polystyrene plastic panel between the at least two H-columns.

33. The method of making a polystyrene plastic fence according to claim 32 wherein the step of supporting each of at least two columns further comprises the step of supporting each of at least two polystyrene plastic H columns on the concrete footing.

34. The method of making a polystyrene plastic fence according to claim 32 further comprising the step of:

using at least one reinforcing bar to structurally fasten the at least one panel and at least one of the at least two H columns together.

35. A method of making a polystyrene plastic fence comprising:

supporting each of at least two polystyrene plastic H columns having a central hollow on a concrete footing by placing each column over a rebar which is secured in the concrete footing and extends into the central hollow of each column;

then, pouring concrete into the central hollow so that each column structure is reinforced to the rebar and the footing; and supporting at least one panel between the at least two H columns.

36. The method of making a polystyrene plastic fence according to claim 35 further comprising the step of:

using at least one reinforcing bar to structurally fasten the at least one panel and at least one of the at least two H columns together.

* * * * *